US005267000A

United States Patent [19]

Miyamoto et al.

[11] Patent Number: 5,267,000

[45] Date of Patent: Nov. 30, 1993

[54] LIGHT AMOUNT CONTROLLER FOR USE IN AN IMAGE FORMING APPARATUS

[75] Inventors: Naruyuki Miyamoto, Sakai; Susumu Takehara, Osaka, both of Japan

[73] Assignee: Mita Industrial Co., Ltd., Osaka, Japan

[21] Appl. No.: 985,422

[22] Filed: Dec. 4, 1992

[30] Foreign Application Priority Data

Dec. 17, 1991 [JP] Japan ..... 3-333374

[51] Int. Cl.[5] ..... G03G 15/04

[52] U.S. Cl. ..... 355/214; 355/243; 355/69

[58] Field of Search ..... 355/208, 214, 228, 243, 355/68, 69, 240

[56] References Cited

U.S. PATENT DOCUMENTS 4,573,787 3/1986 Sanbayashi et al. ..... 355/214
4,619,520 10/1986 Araya ..... 355/214
5,043,766 8/1991 Oushiden et al. ..... 355/214

FOREIGN PATENT DOCUMENTS 63-98539 6/1988 Japan .

*Primary Examiner*—Joan H. Pendegrass
*Attorney, Agent, or Firm*—Jordan and Hamburg

[57] ABSTRACT

A variable magnification electrophotographic image forming apparatus is provided with a controller for the light emission amount of the exposure lamp so as to attain a desired toner image density. The controller includes a calculator for calculating the light emission amount according to the set magnification based on a relationship between the light emission amount and the magnification amount and a correcting device for correcting the calculated light emission amoubt based on a relationship between the density of the original, the temperature of the photosensitive member, the surface potential, or the toner density in the developing unit and the toner image density.

7 Claims, 6 Drawing Sheets

LIGHT AMOUNT CONTROLLER FOR USE IN AN IMAGE FORMING APPARATUS

BACKGROUND OF THE INVENTION AND RELATED ART STATEMENT

This invention relates to a light amount control of an exposure lamp executed in a copying machine or like image forming apparatus provided with a magnification changing function such as an enlargement mode and a reduction mode.

Conventionally, a copying machine or like image forming apparatus has been designed such that the light from an exposure lamp provided in an optical system is projected onto a document face, and the light reflected by the document face is introduced to a photosensitive member to thereby form an electrostatic latent image on the surface of the photosensitive member.

Regarding an amount of light emitted from the exposure lamp, there has been proposed a system of correcting the light amount at a life size magnification according to a set magnification in an enlargement mode or a reduction mode in order to obtain a desired toner image density (Japanese Unexamined Utility Model Publication No. 63-98539).

In the above prior art, only the magnification is considered as a factor influencing the toner image density, but no consideration is made on other factors including the density of the document and the set exposure amount.

These factors mainly originate in the optical system. For example, the distance between the exposure lamp and the photosensitive member, i.e. the length of an optical path, is fixed independently of the magnification. However, the distance between the exposure lamp and a lens is shortened in the enlargement mode while being lengthened in the reduction mode. Accordingly, the reflectance of the lens is fixed despite the variation in the brightness of the exposure lamp, whereas an amount of light reflected by the lens varies as the brightness of the exposure lamp varies, thereby causing an amount of light transmitted through the lens to vary.

Further, an aperture of the lens differs depending upon the magnification. Moreover, the reflectance, the aperture, and the like differ completely depending upon the type and the construction of a lens unit.

The exposure lamp is required to have the light amount thereof corrected according to the levels of the respective factors influencing the toner image density excluding the magnification.

An optimum light amount of the exposure lamp which will provide a desired toner image density cannot be obtained in the enlargement mode and the reduction mode merely by adjusting the light amount by the same amount corrected at the lift-size magnification. Thus, the conventional image forming apparatus has suffered the incapability of controlling the light amount of the exposure lamp optimally according to the levels of the various factors.

SUMMARY OF THE INVENTION

In view of the problems residing in the prior art, it is an object of the invention to provide an image forming apparatus capable of correcting an amount of light emitted from an exposure lamp in consideration of factors which will influence the toner image density when the magnification is changed.

Accordingly, an image forming apparatus of the invention comprises an exposure lamp for emitting the light so as to illuminate a document; magnification changer means for increasing and reducing the magnification of a reflected light image from the document; imaging means including a photosensitive member and a charger for charging the photosensitive member, and adapted for forming an image on the surface of the photosensitive member from the reflected light image passed through the magnification changer means; developing means for causing charged toner to deposit on the formed image whereby to form a toner image; and control means for controlling a light emission amount of the exposure lamp so as to attain a desired toner image density. The control means may advantageously include calculator means for calculating the light emission amount according to the set magnification based on a relationship between the light emission amount and the magnification of the magnification changer means so as to attain the desired toner image density, and correction means for correcting the calculated light emission amount based on a relationship between a factor other than the magnification which influences the toner image density and the toner image density.

With the image forming apparatus thus constructed, the calculator means calculates the light emission amount according to the set magnification based on the relationship between the light emission amount and the magnification of the magnification changer means so as to attain the desired toner image density, and the correction means corrects the calculated light emission amount based on the relationship between the factor other than the magnification which influences the toner image density and the toner image density. Thus, the image of the desired toner image density can be obtained.

The calculator means may include first memory means for storing the relationship between the light emission amount and the magnification.

Further, the correction means may include second memory means for storing in advance a correction amount as related to the magnification based on the relationship between the factor and the toner image density.

The factors other than the magnification which influences the toner image density include the document density, the temperature of the photosensitive member, the surface potential of the photosensitive member, and the toner density in the developing means.

These and other objects, features and advantages of the present invention will become more apparent upon a reading of the following detailed description and accompanying drawings.

DETAILED DESCRIPTION OF PREFERRED EMBODIMENTS OF THE INVENTION

Figure 1:
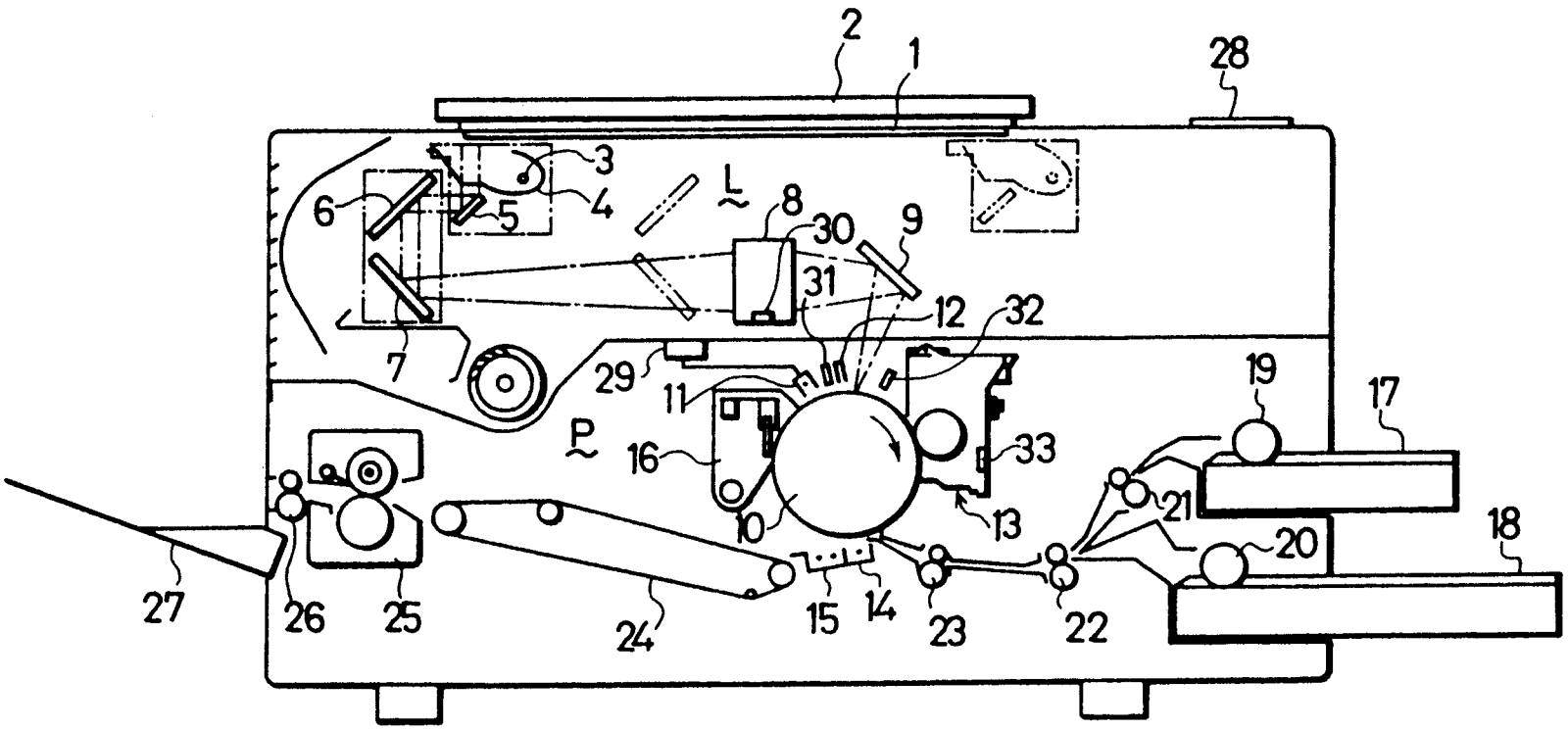
FIG. 1 is a schematic construction diagram showing an image forming apparatus embodying the invention.

There will be described a schematic construction of an image forming apparatus incorporating a light amount control device according to the invention with reference to FIG. 1.

This image forming apparatus is provided with a transparent document platen 1 and a document holder 2 at the top thereof, and is internally provided with an optical system L, an imaging assembly P, a transport assembly for transporting copy sheets, and other components.

The optical system L is provided with a light source unit, reflecting mirrors 5, 6, 7, a lens unit 8, and a fixed mirror 9. The light source unit includes an exposure lamp 3 and a reflector 4, and moves reciprocally so as to scan a document image. The reflecting mirrors 5 to 7 reflect the light reflected by the document face to thereby define an optical path. The lens unit 8 adjusts the magnification of an image to be formed, or the like. The fixed mirror 9 reflects the reflected light so as to direct the same to a photosensitive member 10.

The imaging assembly P is provided with the photosensitive member 10 in the form of a drum, a charger 11, a high voltage supply 29, a blank lamp 12, a developing device 13, a transfer charger 14, a separating charger 15, a cleaning device 16, etc. The photosensitive member 10 has an electrostatic latent image formed on the surface thereof. The charger 11 charges the photosensitive member 10 at a set surface potential. The high voltage supply 29 supplies a high voltage to the charger 11. The blank lamp 12 removes electric charges on an unnecessary portion of the surface of the photosensitive member 10. The developing device 13 causes the toner to be charged and attracted to the electrostatic latent image so as to develop the same into a toner image. The transfer charger 14 transfers the toner image onto a sheet, and the separating charger 15 separates the image bearing sheet from the surface of the photosensitive member 10. The cleaning device 16 cleans the toner residual on the surface of the photosensitive member 10 after the image transfer operation.

The transport assembly includes cassettes 17, 18 for containing different sized sheets therein, feed rollers 19, 20 for feeding the sheets, pairs of transport rollers 21, 22, and a pair of registration rollers 23 arranged in this order from an upstream side with respect to a transport direction of the sheet. Further, downstream of the photosensitive member 10, there are arranged a transport belt 24 for transporting the sheet, a fixing device 25 for fixing the toner image onto the sheet, a pair of discharge rollers 26 for discharging the sheet onto a discharge tray 27, and the like.

The image forming apparatus is further provided with various sensors. These sensors include a document density sensor 30 for detecting the document density, a surface potential sensor 31 for detecting the surface potential of the photosensitive member 10, a temperature sensor 32 for detecting an ambient temperature, and a toner sensor 33 for detecting the toner density. Specifically, the document density sensor 30 is arranged at a specified position in the lens unit 8; the surface potential sensor 31 and the temperature sensor 32 are arranged at specified positions around the photosensitive member 10, and the toner sensor 33 is arranged at a specified position in the developing device 13.

Further, an operation panel 28 is provided at a specified position of an upper surface of the image forming apparatus. The operation panel 28 includes setting keys for setting the size of the document and the copy sheet, an enlargement mode and a reduction mode, a light amount setting key for manually setting the light amount of the exposure lamp, etc.

Figure 2:
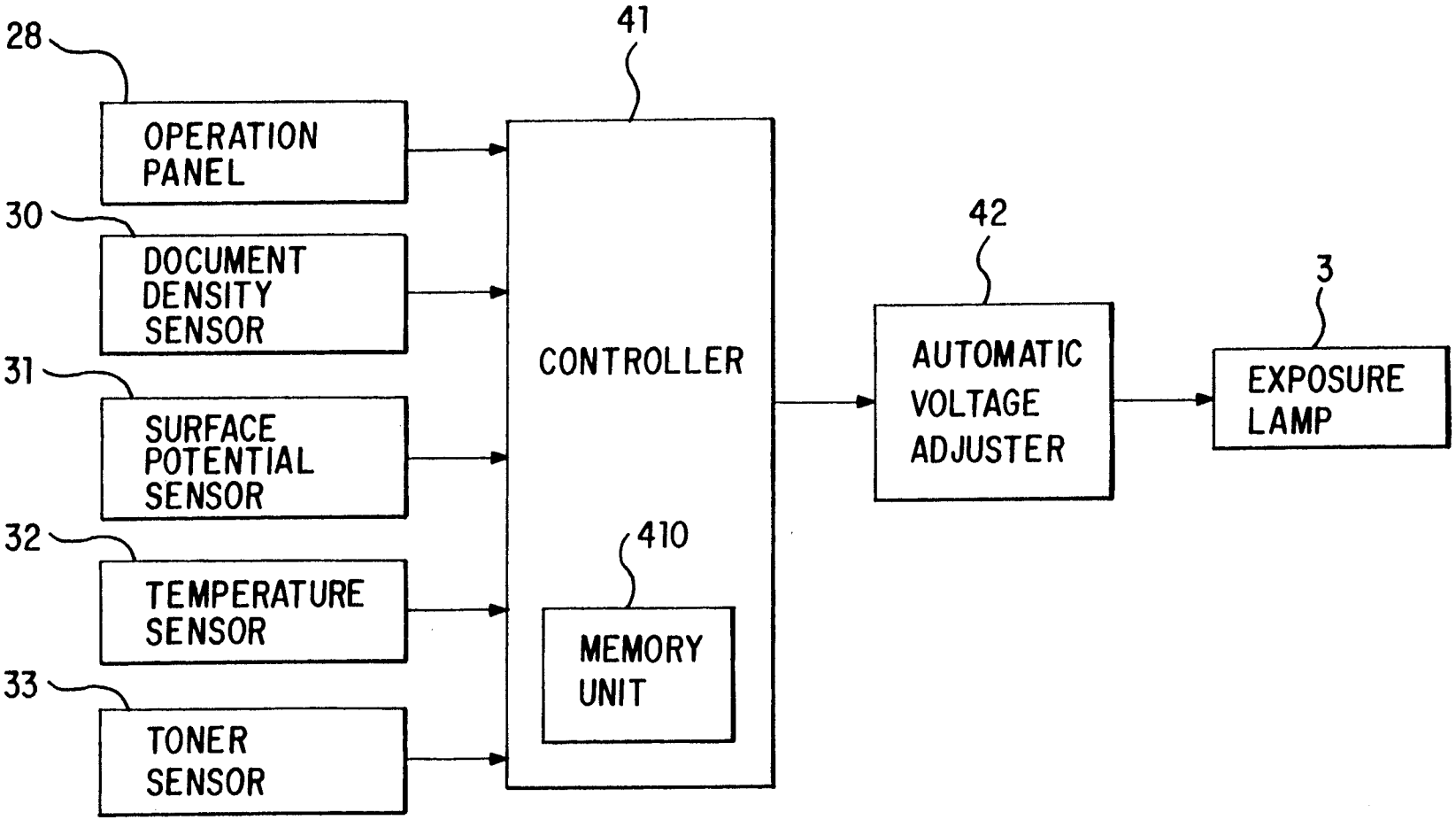
FIG. 2 is a block diagram showing a construction of a control system provided in the image forming apparatus.

There will be described a control system of the image forming apparatus next with reference to FIG. 2.

A controller 41 includes a microcomputer and a memory unit 410, and controls an overall operation of the image forming apparatus. A main program describing an operation procedure and the like is stored in an unillustrated builtin ROM.

The memory unit 410 stores various data including data for the sensors 30 to 33, and target light amounts relative to the magnification set in the enlargement mode or the reduction mode when a standard light amount is set.

The controller 41 determines a correction amount of the light amount of the exposure lamp 3 relative to the target light amount in accordance with signals from the respective sensors 30 to 33 and the light amount setting key, and controls the light amount of the exposure lamp 3 by controlling a voltage applied to the exposure lamp 3 through an automatic voltage adjuster 42.

There will be described a control of correcting the light amount of the exposure lamp according to the invention as related to the detection data of the respective sensors 30 to 33 and the setting of the light amount setting key in the operation panel next with reference to FIG. 3.

In this figure, indicated at S is a control curve representing a light amount as a function of the magnification in the case where the detection data of the respective sensors 30 to 33 and the setting of the light amount setting key are standard, indicated at A a control curve representing a light amount as a function of the magnification in the case where the light amount is reduced from the standard level, and indicated at B a control curve representing a light amount as a function of the magnification in the case where the light amount is increased from the standard level.

For example, when it is detected that the document density is low by means of the document density sensor 30, the light amount is preferably reduced in order to obtain an optimum image from that document, thus shifting the control curve from S to A. On the other hand, when the document density is detected to be high, it is required to increase the light amount for the similar purpose, thus shifting the control curve from S to B.

Also, when a reduction in the surface potential of the photosensitive member 10 is detected by means of the surface potential sensor 31, the control curve is shifted from S to A since the large light amount is unnecessary. On the other hand, when an increase in the surface potential of the photosensitive member 10 is detected, the control curve is shifted from S to B since the large light amount is necessary.

Further, when the temperature of the photosensitive member 10 is detected to be high by means of the temperature sensor 32, it becomes hard for the electric charges to be attracted to the photosensitive member 10, thereby reducing the surface potential of the photosensitive member 10. Accordingly, the control curve is shifted from S to A since the large light amount is unnecessary. On the other hand, when the temperature of the photosensitive member 10 is detected to be low, the control curve is shifted from S to B since the large light amount is necessary to the contrary.

Moreover, when a reduction in the toner density in the developing device 13 is detected by means of the toner sensor 33, the toner becomes hard to be attracted to the photosensitive member 10. Accordingly, the control curve is shifted from S to A since the large light amount is unnecessary. On the other hand, an increase in the toner density is detected, the control curve is shifted from S to B to the contrary.

Further, when the light amount smaller than the standard level is set through the light amount setting key, the control curve is shifted from S to A. On the other hand, when the light amount greater than the standard level is set, the control curve is shifted from S to B to the contrary.

Figure 3:
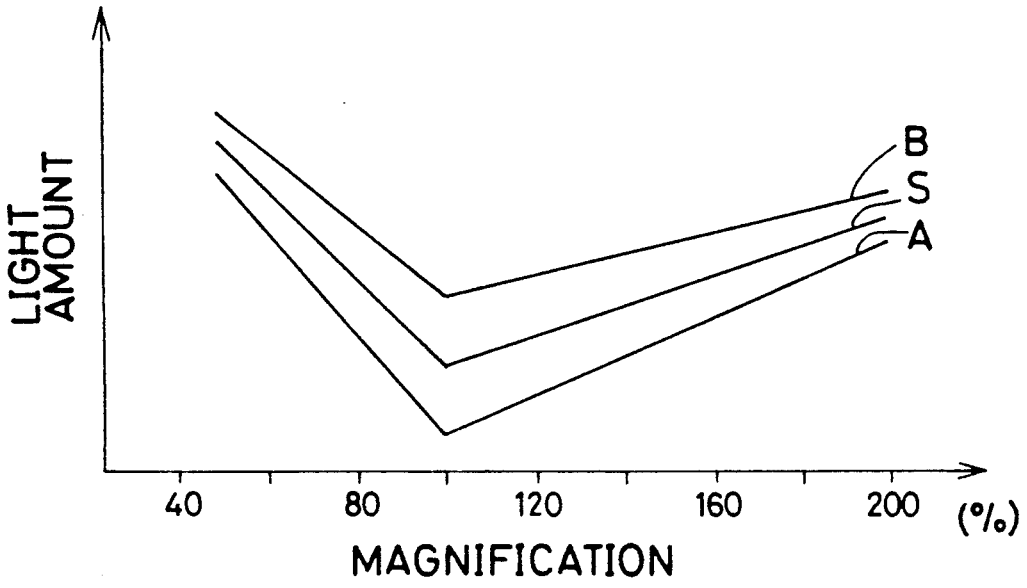
FIG. 3 is a graph showing correction of a light amount of the exposure lamp relative to factors influencing the toner image density.

As shown in FIG. 3, the control curves A and B are not vertically parallel with the control curve S. Specifically, an amount of the light amount corrected by shifting the control curve from S to A or from S to B becomes smaller as the magnification increases from the life-size magnification or decreases therefrom.

There will be next described an example of the light amount correction of the exposure lamp 3 according to the invention with respect to a case where the light amount is corrected according to the level of the document density.

Figure 4A:
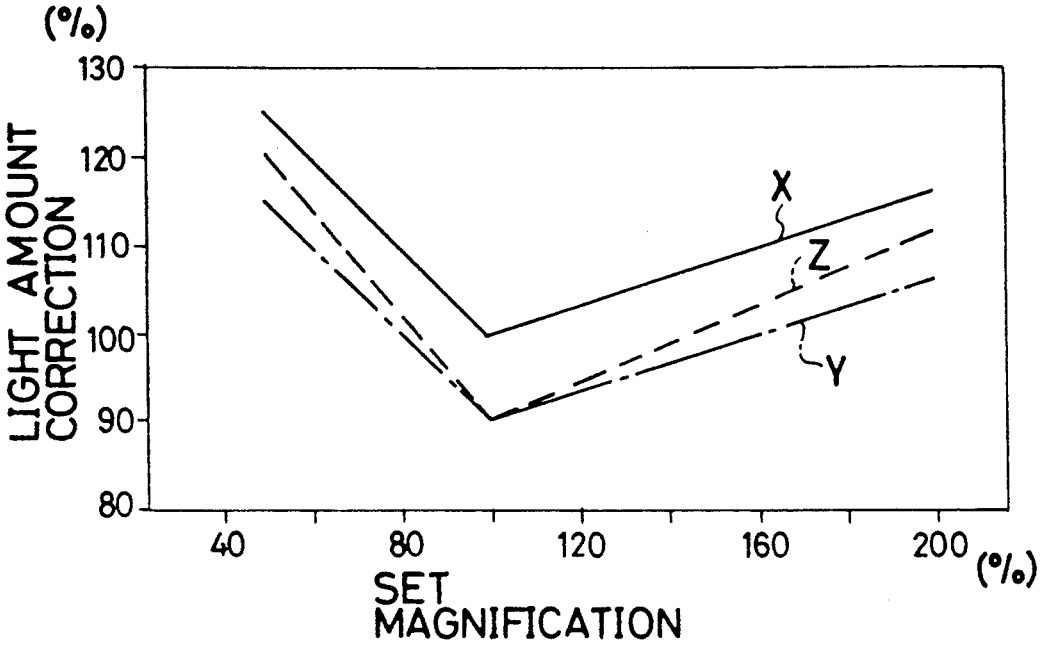
FIG. 4A is a graph representing a light amount ratio as related to a set magnification so as to show the correction of the light amount of the exposure lamp when the document density is low.

Referring to FIG. 4A, there is first described the light amount correction in the case where the document density is low. In FIG. 4A, a solid line curve X represents the light amount as a function of the set magnification when the document density is at the standard level; a phantom line curve Y represents the light amount as a function of the set magnification when the document density is below the standard level according to the prior art; a broken line curve Z represents the light amount as a function of the set magnification the document density is below the standard level according to the invention. As seen from the curve Y vertically parallel with the curve X, according to the prior art, the light amount correction according to the level of the document density is the same entire range of the magnification. When the document density is at the standard level, the light amount ratio is increased to +15% at the set magnification of 200% while being increased to +25% at the set magnification of 50%. It will be appreciated that the light amount ratio is a ratio of the light amount at a given magnification to the one at the life-size magnification and at the standard level in terms of some factor influencing the toner image density (the document density in this example).

The light amount ratio at the time of the life-size magnification is set at −10%, i.e. 90%, in the case where the document density is low, compared to the case where the document density is at the standard level.

In this case, unlike the case where the document density is at the standard level, the light amount ratio at the magnification of 200% is not set at +15%, i.e. 105% (the phantom line curve Y in FIG. 4A), but set at +20%, i.e. 110% (the broken line Z in FIG. 4A). In other words, the inclination of the curve Z is greater than that of the curve X.

Further, unlike the case where the document density is at the standard level, the light amount ratio at the magnification of 50% is not set at +25%, i.e. 115% (the phantom line curve Y in FIG. 4A), but set at +30%, i.e. 120% (the broken line Z in FIG. 4A).

Figure 4B:
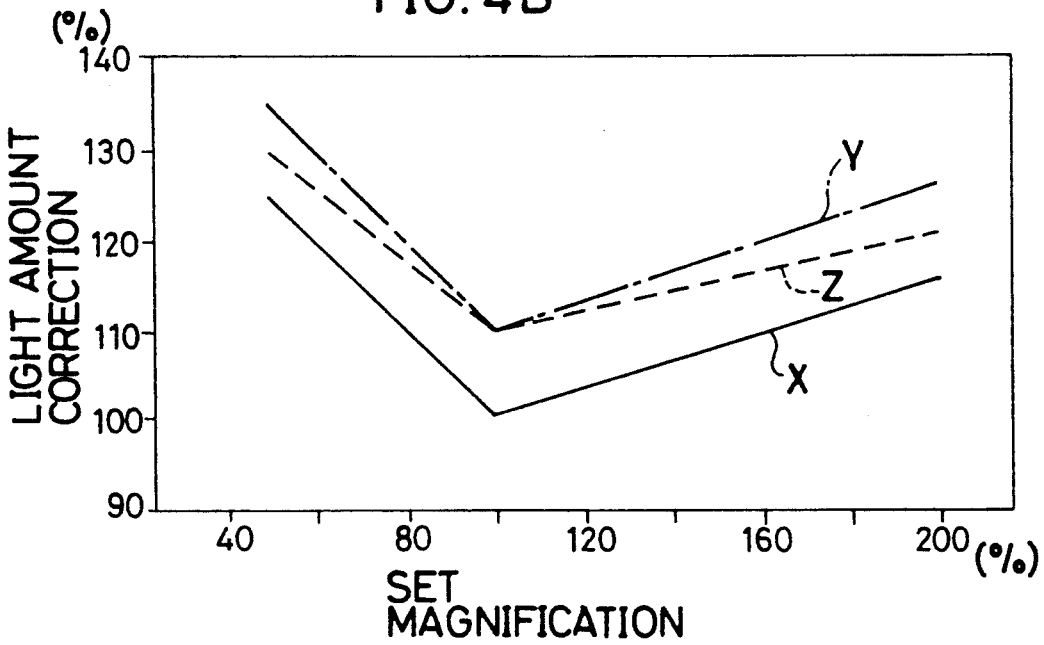
FIG. 4B is a graph representing the light amount ratio as related to a set magnification so as to show the correction of the light amount of the exposure lamp when the document density is high.

Referring to FIG. 4B, there is described the light amount correction in the case where the document density is high. In FIG. 4B, a solid line curve X represents the light amount as a function of the set magnification when the document density is at the standard level; a phantom line curve Y represents the light amount as a function of the set magnification according to the prior art when the document density is above the standard level; a broken line curve Z represents the light amount as a function of the set magnification according to the invention when the document density is above the standard level. Similar to the case shown in FIG. 4A, when the document density is at the standard level, the light amount ratio is increased to +15% at the set magnification of 200% while being increased to +25% at the set magnification of 50%.

The light amount ratio at the life-size magnification is set at +10%, i.e. 110%, in the case where the document density is high.

In this case, unlike the case where the document density is at the standard level, the light amount ratio at the magnification of 200% is not set at +15%, i.e. 125% (the phantom line curve Y in FIG. 4B), but set at +10%, i.e. 120% (the broken line Z in FIG. 4B). In other words, the inclination of the curve Z is smaller than that of the curve X.

As will be seen from the above, in the case where the document density is high or low, the light amount is not corrected by the same amount as the one corrected at the life-size magnification, but is corrected by adding $+\alpha$ ($\alpha$ can be a negative value) thereto so as to obtain the optimum light amount constantly.

The necessity to add $+\alpha$ to the correction amount at the life-size magnification comes mainly from the characteristic of the optical system L. For example, the distance between the exposure lamp 3 and the photosensitive member 10, i.e. the length of an optical path, is fixed independently of the set magnification. However, the distance between the exposure lamp 3 and the lens unit 8 is shortened in the enlargement mode while being lengthened in the reduction mode.

The reflectance of the lens unit 8 is fixed despite the variation in the amount of light emitted from the exposure lamp 3, whereas an amount of light refleced by the lens unit 8 varies as the light amount of the exposure lamp varies, thereby causing an amount of light transmitted through the lens unit 8 to vary.

Further, an aperture of the lens differs depending upon the set magnification. Moreover, the reflectance, the aperture, and the like differ completely depending upon the type and the construction of the lens unit. Thus, it is necessary to correct the light amount by adding to the correction amount at the life-size magnification $+\alpha$ suitable for the characteristic of the optical system L using the aforementioned technique.

Figure 5:
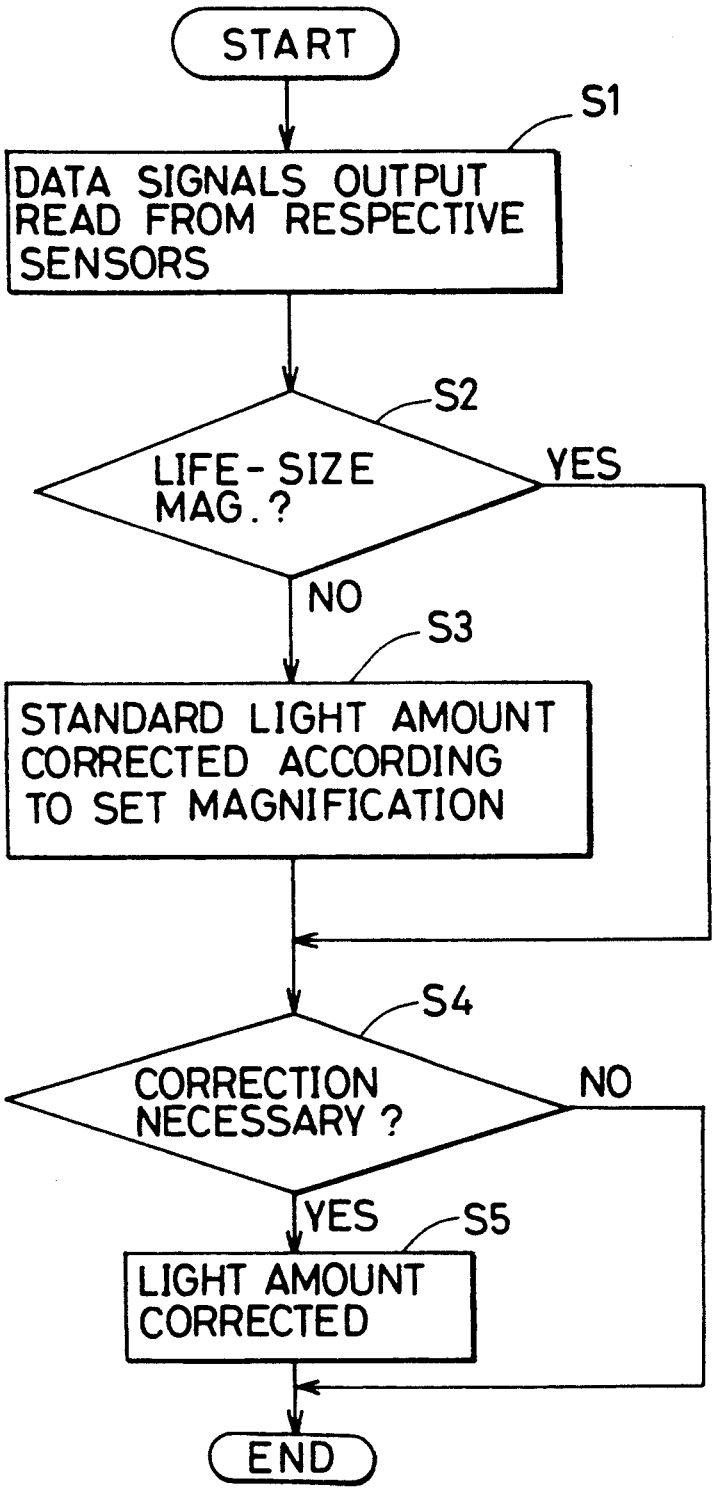
FIG. 5 is a flow chart showing an exemplary procedure of correcting the light amount.

There will be described a procedure of the light amount correction next with reference to a flow chart shown in FIG. 5.

Upon start of an image forming operation, the controller 41 reads data signals output from the respective sensors 30 to 33 and the light amount setting key in the operation unit 28 in Step S1. Then, it is discriminated whether the magnification set through the operation panel 28 is the life-size magnification in Step S2. If the set magnification is the life-size magnification (YES in Step S2), this routine proceeds to Step S4. If not, the standard light amount correction is made according to the set magnification (solid line curve X in FIG. 4A or 4B) in Step S3. Subsequently, in Step S4, it is discriminated whether any further light amount correction is necessary based on the data read in Step S2 (Step S4). If no further light amount correction is necessary, i.e. the data from the respective sensors 30 to 33 all represent the standard values, this routine ends. On the other hand, if a further light amount correction is necessary, the light amount is corrected according to the respective data (line X→line Z in FIG. 4A or 4B) in Step S5 and this routine ends.

In this way, the light amount is not corrected by the same correction amount as at the life-size magnification when the set magnification is set other than the life-size magnification in view of the level of the factors influencing the toner image density excluding the magnification, but corrected so as to make the light amount suitable for the optical system L based on the data from the respective sensors 30 to 33. Thus, the optimum light amount can be obtained constantly.

If it is required to correct the light amount in according with the data from the respective sensors 30 to 33 in the correction procedure, it may be appropriate to carry out the light amount correction at the life-size magnification and then to carry out the light amount correction according to the set magnification by adding $+\alpha$.

Figure 6:
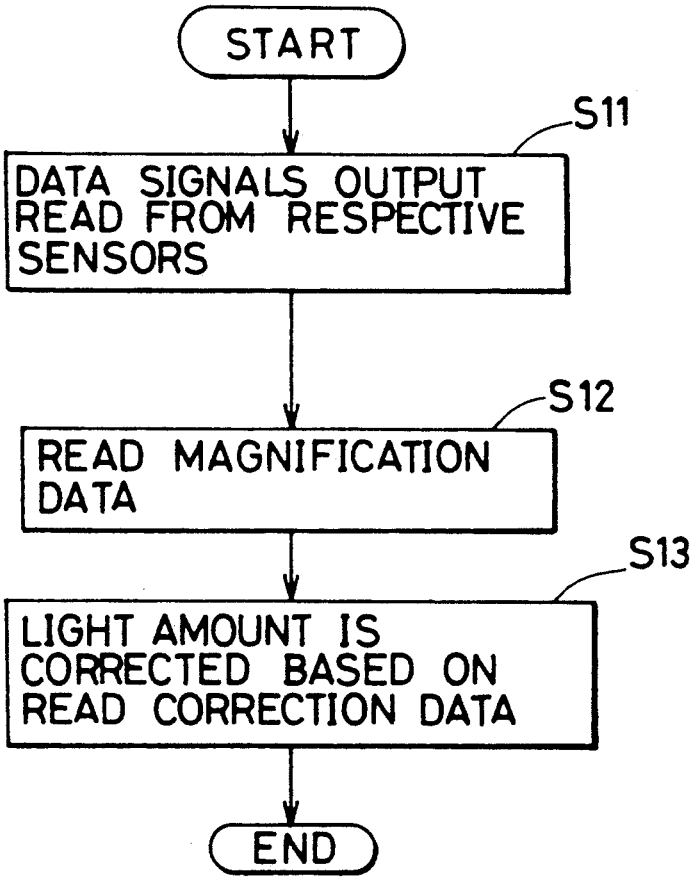
FIG. 6 is a flow chart showing another procedure of correcting the light amount.

There will be described another procedure of the light amount correction with reference to a flow chart shown in FIG. 6. It will be appreciated that this procedure employs the construction of the control system similar to the above procedure, and that the memory unit 410 stores the set magnifications in the enlargement mode and the reduction mode, and optimum voltages to be applied to the exposure lamp 3 which can be obtained based on the data from the respective sensors 30 to 33 and the light amount setting key in the operation panel 28 in the form of a table in advance.

Upon start of an image forming operation, the controller 41 reads data signals output from the respective sensors 30 to 33 and the light amount setting key in the operation unit 28 in Step S11, and read the magnification data set through the operation panel 28 in Step S12. Subsequently, a light amount correction data is read from the table stored in the memory unit 410 based on the read data, and the light amount of the exposure lamp 3 is corrected using thus obtained light amount correction data in Step S13. Then, this routine ends.

In this way, the light amount is not corrected by the same correction amount as at the life-size magnification when the set magnification is set other than the life-size magnification in view of the level of the factors influencing the toner image density excluding the magnification. Instead, the light amounts suitable for the optical system L are stored in advance, and an optimum value is selected from the stored data based on the data from the respective sensors 30 to 33, thereby obtaining the optimum light amount constantly.

It may be also appropriate to store in the memory unit 410 an operation expression in place of the table and to calculate the optimum light amount based on the data from the respective sensors 30 to 22 in accordance with the stored operation expression.

Although the present invention has been fully described by way of example with reference to the accompanying drawings, it is to be understood that various changes and modifications will be apparent to those skilled in the art. Therefore, unless otherwise such changes and modifications depart from the scope of the present invention, they should be construed as being included therein.

What is claimed is:

1. An image forming apparatus comprising:

an exposure lamp for emitting the light so as to illuminate a document;

magnification changer means for increasing and reducing the magnification of a reflected light image from the document;

imaging means including a photosensitive member and a charger for charging the photosensitive member, and adapted for forming an image on the surface of the photosensitive member from the reflected light image passed through the magnification changer means;

developing means for causing charged toner to deposit on the formed image whereby to form a toner image; and control means for controlling a light emission amount of the exposure lamp so as to attain a desired toner image density; the control means including:

calculator means for calculating the light emission amount according to the set magnification based on a relationship between the light emission amount and the magnification of the magnification changer means so as to attain the desired toner image density; and correction means for correcting the calculated light emission amount based on a relationship between a factor other than the magnification which influences the toner image density and the toner image density.

2. An image forming apparatus as defined in claim 1 wherein the calculator means includes a first memory means for storing the relationship between the light emission amount and the magnification.

3. An image forming apparatus as defined in claim 2 wherein the correction means includes a second memory means for storing in advance a correction amount as related to the magnification based on the relationship between the factor and the toner image density.

4. An image forming apparatus as defined in claim 1 wherein the factor is the density of the document.

5. An image forming apparatus as defined in claim 1 wherein the factor is the temperature of the photosensitive member.

6. An image forming apparatus as defined in claim 1 wherein the factor is the surface potential of the photosensitive member.

7. An image forming apparatus as defined in claim 1 wherein the factor is the toner density in the developing means.

* * * * *